US007421957B2

(12) United States Patent
Baez

(10) Patent No.: US 7,421,957 B2
(45) Date of Patent: Sep. 9, 2008

(54) OVERHEAD STORAGE SYSTEM

(76) Inventor: Michael Baez, 6221 Paseo Privado, Carlsbad, CA (US) 92009-1910

( * ) Notice: Subject to any disclaimer, the term of this patent is extended or adjusted under 35 U.S.C. 154(b) by 0 days.

(21) Appl. No.: 11/234,649

(22) Filed: Sep. 23, 2005

(65) Prior Publication Data

US 2006/0065164 A1 Mar. 30, 2006

Related U.S. Application Data

(60) Provisional application No. 60/613,037, filed on Sep. 25, 2004.

(51) Int. Cl.
*A47B 23/00* (2006.01)

(52) U.S. Cl. ..... 108/42; 108/149; 211/113

(58) Field of Classification Search ..... 108/42, 108/149, 186; 211/113, 118, 186, 119, 117; 52/30, 506.06, 764, 506.01, 506.07
See application file for complete search history.

(56) References Cited

U.S. PATENT DOCUMENTS

| | | | | |
|---|---|---|---|---|
| 276,241 | A | 4/1883 | Hanavan | |
| 1,566,551 | A | 12/1925 | Ghrand | |
| 2,458,332 | A | 1/1949 | Boschan | |
| 3,110,934 | A | 11/1963 | Triplett | |
| 3,139,045 | A * | 6/1964 | Rojakovick | 108/109 |
| 3,695,569 | A | 10/1972 | Pullan | |
| 3,735,951 | A * | 5/1973 | Reed | 248/340 |
| 4,037,813 | A | 7/1977 | Loui et al. | |
| 4,053,132 | A | 10/1977 | Del Pozzo | |
| 4,373,448 | A | 2/1983 | Pallotta | |
| 4,385,565 | A | 5/1983 | Roberts et al. | |
| D270,034 | S | 8/1983 | Shepard | |
| 4,429,850 | A | 2/1984 | Weber et al. | |
| 4,432,523 | A | 2/1984 | Follows | |
| 4,508,301 | A | 4/1985 | Nicholson et al. | |
| 4,548,378 | A | 10/1985 | Worrallo | |
| 4,582,001 | A | 4/1986 | Leikarts | |
| D289,495 | S | 4/1987 | Hughes et al. | |
| 4,656,952 | A | 4/1987 | Schweizer | |
| 4,729,483 | A | 3/1988 | Schrader | |
| 4,732,358 | A | 3/1988 | Hughes et al. | |

(Continued)

OTHER PUBLICATIONS

Borroughs Corporation; Rivet-Span Catalog (12 pp).

(Continued)

*Primary Examiner*—José V Chen
(74) *Attorney, Agent, or Firm*—Scheinberg & Griner LLP; David Griner; Michael O. Scheinberg

(57) ABSTRACT

An overhead storage system includes support beams forming a frame to a deck around its perimeter and four corner vertical mounts for suspending the deck from a ceiling. The frame is preferably made of Z-shaped beams supported by vertical L-shaped corner supports to provide strong support for a deck. The Z-shaped beams provide strength and a horizontal surface on which a deck can be rested. A welded wire deck can be strengthened by bonding it to ribs. In some embodiments, center supports can preferably be positioned anywhere along the length of the support beams, and do not require holes in the beams for mounting. The beams are preferably connected to the vertical corner brackets without using threaded fasteners, thereby making the assembly easier for assembly by a homeowner.

21 Claims, 10 Drawing Sheets

U.S. PATENT DOCUMENTS

| | | | | |
|---|---|---|---|---|
| 4,736,918 | A | 4/1988 | Bessinger | |
| 4,765,575 | A | 8/1988 | Bergl et al. | |
| D300,397 | S | 3/1989 | Michaelsen | |
| 4,821,892 | A | 4/1989 | Randall | |
| D302,240 | S | 7/1989 | Zell | |
| 4,871,136 | A | 10/1989 | Bessinger et al. | |
| 4,904,032 | A | 2/1990 | Jenkins | |
| 4,915,338 | A | 4/1990 | Guth | |
| 4,934,642 | A | 6/1990 | Baron et al. | |
| D310,165 | S | 8/1990 | Cobb | |
| D313,720 | S | 1/1991 | Sorenson et al. | |
| 5,020,758 | A | 6/1991 | Rawlyk | |
| D318,414 | S | 7/1991 | Righini | |
| D321,618 | S | 11/1991 | Stumpf et al. | |
| D321,620 | S | 11/1991 | Stumpf et al. | |
| D321,622 | S | 11/1991 | Stumpf et al. | |
| 5,253,837 | A | 10/1993 | Loux | |
| 5,310,148 | A | 5/1994 | Dorr | |
| 5,355,810 | A | 10/1994 | Camilleri | |
| 5,384,198 | A | 1/1995 | Hodges | |
| D361,931 | S | 9/1995 | Cesler | |
| D367,001 | S | 2/1996 | Bright | |
| 5,503,358 | A | 4/1996 | Lapp | |
| 5,553,549 | A * | 9/1996 | Nilsson | 108/110 |
| 5,580,018 | A | 12/1996 | Remmers | |
| 5,647,490 | A | 7/1997 | Hull | |
| 5,695,079 | A | 12/1997 | Peay | |
| D388,694 | S | 1/1998 | Cohen | |
| 5,755,416 | A | 5/1998 | Leek | |
| 5,833,190 | A | 11/1998 | Bishop | |
| D411,738 | S | 6/1999 | Raasch et al. | |
| D415,015 | S | 10/1999 | Pare et al. | |
| 6,016,928 | A | 1/2000 | Cothran et al. | |
| 6,053,465 | A | 4/2000 | Kluge | |
| 6,145,678 | A * | 11/2000 | Morrison | 211/113 |
| 6,161,709 | A | 12/2000 | Kluge et al. | |
| 6,286,691 | B1 | 9/2001 | Oberhaus et al. | |
| 6,311,626 | B1 * | 11/2001 | Roberts | 108/42 |
| 6,318,570 | B1 | 11/2001 | Mueller et al. | |
| 6,354,682 | B1 | 3/2002 | Nott et al. | |
| 6,409,031 | B1 * | 6/2002 | Wynne | 211/119 |
| 6,435,105 | B1 * | 8/2002 | Mikich et al. | 108/42 |
| 6,464,186 | B1 | 10/2002 | Marsh | |
| 6,715,427 | B2 | 4/2004 | Mikich et al. | |
| 6,725,608 | B1 | 4/2004 | Kraus | |
| D508,646 | S | 8/2005 | Gates et al. | |
| D523,327 | S | 6/2006 | Clarke | |
| 7,128,225 | B2 | 10/2006 | Saltzburg et al. | |
| 7,152,535 | B2 | 12/2006 | Mikich et al. | |
| D537,325 | S | 2/2007 | Wolff et al. | |
| D537,326 | S | 2/2007 | Wolff et al. | |
| 7,252,202 | B2 | 8/2007 | Saltzberg et al. | |
| 2002/0043189 | A1 | 4/2002 | Mikich et al. | |
| 2002/0063102 | A1 | 5/2002 | Hanneken | |
| 2003/0136310 | A1 | 7/2003 | Bouffard | |
| 2003/0141263 | A1 | 7/2003 | Dueck | |
| 2004/0020138 | A1 | 2/2004 | Grearson | |

OTHER PUBLICATIONS

RiveTier's Boltless Shelving Instructions (1 p).
Rapid Rack—'Z' Beam Bulk Shelving Instructions (1 p).
Grainger's Catalog No. 394 (3 pp).
Gorilla Rack Products; Assembly Instructions for Storage Rack/Workbench, Model GRZ 8460-5; Revision A (11 pp).
Mecalux; Wide Span Shelving (8 pp).
Ortho Books, How to Design and Build Storage Projects, 1983 (p. 78).
Web pages from www.parsteel.com, Oct. 7, 2000 (4 pp.).
Web pages from www.salcoeng.com, Jan. 25, 1999 (3 pp.).

* cited by examiner

OVERHEAD STORAGE SYSTEM

This application claims priority from U.S. Pat. App. No. 60/613,037 filed Sep. 25, 2004, which is hereby incorporated by reference.

TECHNICAL FIELD OF THE INVENTION

The present invention relates to an overhead storage system that is particularly suitable for use in a garage.

BACKGROUND OF THE INVENTION

People store many items besides cars in the garages of their homes and businesses. Garages tend to collect so much "stuff" that many people can no longer fit their cars in their garages. One way of increasing the storage space available in a garage is to use overhead storage, rather than just using floor space. Several systems have been designed to provide storage space suspended from a ceiling.

For example, U.S. Pat. No. 6,311,626 to Roberts for a "Hanging Storage Shelf System" describes a shelf supported by bars, which in turn are suspended by threaded rods screwed into ceiling joists.

U.S. Pat. No. 6,435,105 to Mikich et al. for a "Suspended Storage Structure" describes the use of one or more welded wire frames connected together to form a shelf for storing items. The welded wire frame is supported underneath by square tubes on two sides, and straps attach the square tubes to brackets attached to a ceiling.

U.S. Pat. No. 6,715,427, also to Mikich et al. for a "Suspended Storage Structure," describes another storage structure that is suspended from a ceiling. The system uses one or more welded wire panels to form a shelf for storing items. The welded wire panels are supported by transverse support pieces that are attached to straps, which are in turn connected to a ceiling beam. The shelves are cantilevered, which reduces the weight that the shelves can support.

U.S. Pat. No. 6,725,608 to Kraus for a "Garage Overhead Storage Assembly" describes a storage shelf supported by three "shelf catching beams" which in turn are supported by metal ties that extend to "ceiling catching beams" that span the ceiling joists.

While each of the systems describe above provides suspended storage, each has disadvantages, such as weight or weight distribution limits, difficulty in juxtaposing units, construction costs, or difficulty of assembly by a homeowner. Various embodiments of the present invention can overcome some or all of those deficiencies.

SUMMARY OF THE INVENTION

An object of the invention is to provide an overhead storage system that provides improved suspended storage. The system includes several novel aspects, not all of which need to be included in every embodiment.

The invention provides a suspended storage system that, in various embodiments, can support a relatively large amount of weight, can be easily assembled from a "do it yourself" kit, can be readily adjusted to different load distributions, and can be juxtaposed to form multiple unit assemblies.

Some embodiments use a frame composed of four beams to support a deck around its perimeter, each beam including a horizontal portion forming a shelf on which the edge of the deck rests. The frame provides strength that is not found in the prior art units described above, and the horizontal portion of the beams provides stability for the deck. In some embodiments, the frame can have a generally Z-shaped cross section; in other embodiments the frame cross section can be L-shaped or C-shaped. In some embodiments, the frame can be formed from expandable support beams so that the frame length and/or width can be adjusted.

Preferred Z-shaped beams provide support strength and facilitate deck attachment. The indentation under the horizontal portion of the Z-shaped beams and above the angled portion provides a place where optional center vertical supports can be attached by clamping them to the beam, thereby allowing center supports to be placed wherever desired along the length of the frame.

Some embodiments use a welded wire deck, the deck being supported from below by ribs to which wires of the deck are bonded to provide stability and sturdiness. Preferred deck support ribs have flat ends to provide broad support to the wire deck near the frame and are V-shaped in the center to provide strength along the span away from the frame. One or more clips can be used to prevent the wire deck from sliding relative to the frame.

In some embodiments, multiple welded wire deck sections or panels can be combined to create a larger wire deck, with cross support ribs perpendicular to the deck support ribs underlying the intersection of adjacent wire decks and supporting the adjacent ends of deck support ribs from each wire deck.

Some embodiments can include a net or other structure that can be affixed so that items on the deck cannot fall off. Some embodiments can include a retractable shade that can be extended to hide the contents of the storage system.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION OF PREFERRED EMBODIMENTS

Figure 1:
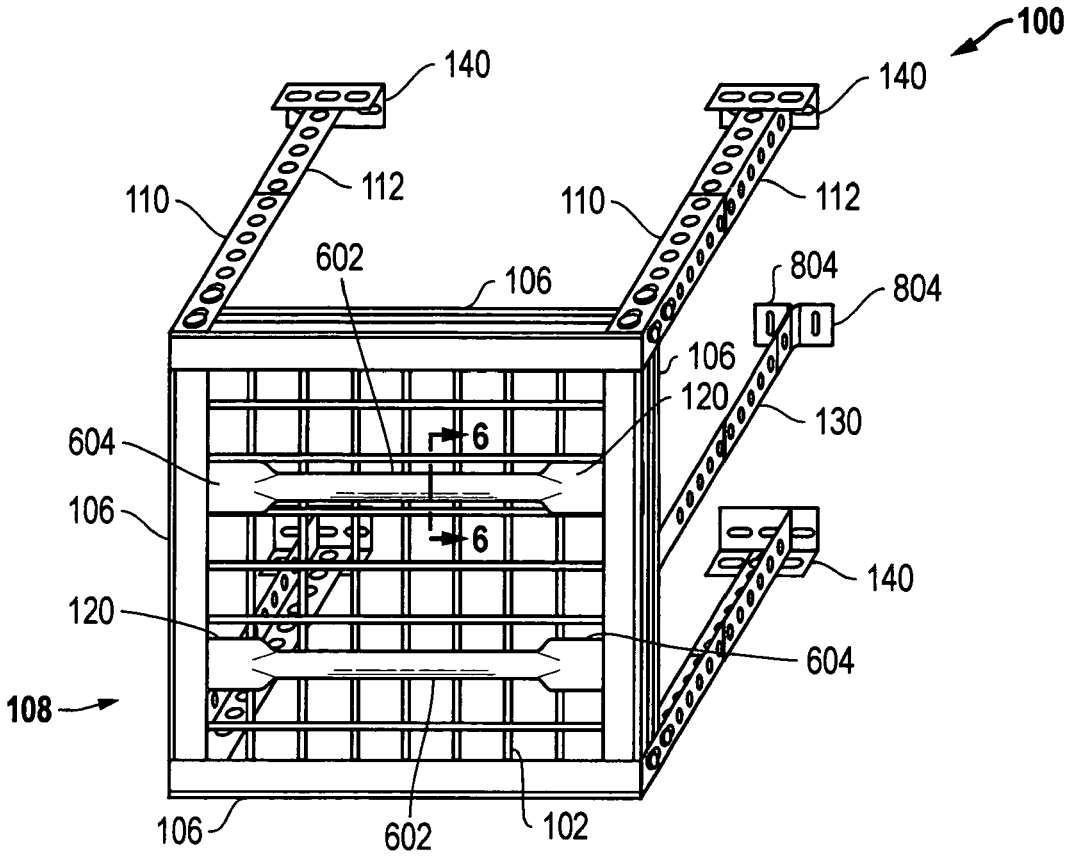
FIG. 1 shows a bottom perspective view of a preferred embodiment of the invention.

FIG. 1 shows a preferred suspended storage structure 100 including a shelf or deck 102 which can be, for example, a welded wire mesh, as shown, or a solid sheet, such as plywood, metal, or plastic. Deck 102 is supported by beams 106 that form a rectangular frame 108. A preferred embodiment uses four beams 106, two longitudinal beams (a front beam and a back beam) and two transverse side beams. Beams 106 are suspended from vertical supports, which preferably comprise a lower vertical corner support 110 and an upper vertical corner support 112. Beams can be formed from steel or any other appropriate material, preferably with a thickness of at least 16 gauge. The vertical supports shown in FIG. 1 comprise L-shaped supports mounted on each corner of deck 102. Preferably, the vertical supports are formed from steel or another appropriate material with a thickness of at least 12 gauge or, more preferably, 10 gauge. Skilled persons will recognize that vertical supports with a different cross-section shape can be used, for example a flat or rectangular cross-section. Further, the vertical supports can be mounted at locations other than the corners of deck 102 as long as the deck is adequately supported.

Figure 2:
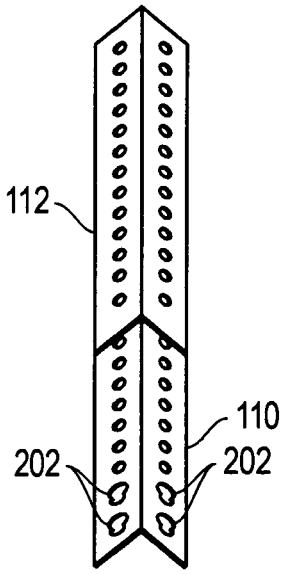
FIG. 2 shows a vertical corner support used in the embodiment shown in FIG. 1.

FIG. 2 shows that upper and lower vertical corner supports 110 and 112 are preferably L-shaped, with sides of approximately equal width. Each lower vertical corner support 110 has two keyhole shaped slots 202 toward the lower end on each of the outer sides of the vertical corner support 110. Deck 102 preferably does not extend past frame 108, thereby eliminating weaker cantilevered deck portions and facilitating the side-by-side placement of multiple storage structures 100. Vertical corner supports are preferably, but not always, constructed in two parts, such as upper part 112 and lower part 110, so that a user can adjust the height of the supports by overlapping different amounts of the upper and lower parts. The two parts can be connected using bolts, or other means, such as interlocking slots on one piece and protrusions on the other piece. For example, in one embodiment, the length of the combination of vertical corner supports 110 and 112 can be adjusted to be between 20 inches and 38 inches in 1½-inch increments. The holes in upper part 112 have appropriate shapes for the connectors, for example, round holes if bolts are used, or key hole slots for connecting to protrusions in the mating members. The shape of the holes need not match the shape of the connectors exactly, for example oval holes could be used with bolts to allow for more adjustability.

Figure 3:
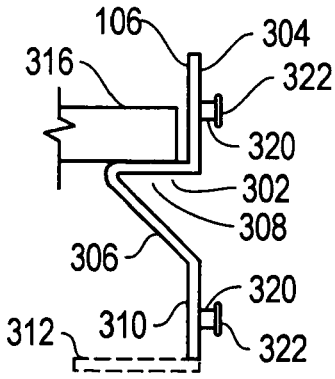
FIG. 3 shows an end view of a Z-shaped beam used in the embodiment of FIG. 1.

FIG. 3 shows one preferred shape for beams 106. A preferred beam 106 comprises a 14-gauge steel, 2½-inch wide, heavy-duty steel Z-shaped beam. (The term "Z-shaped" as used herein is not limited to beams having two horizontal and one angled portion between them like the letter "Z", but includes any beam having a cross section with multiple portions including an angled portion that is not substantially perpendicular to a connected portion.) The Z-shaped beams 106 include a horizontal portion 302 and a first vertical portion 304 that extends upward from one end of the horizontal portion 302. As shown in FIG. 3, deck 316 rests upon horizontal portion 302, while butting up against the bottom of vertical portion 304. In some embodiments, the top of vertical portion 304 can extend above deck 316. An angled portion 306 extends from the end of horizontal portion 302 opposite to that of vertical portion 304 downwardly and toward the plane of vertical portion 302. Below horizontal surface 302 and above angled portion 306 is a space referred to as indentation 308. A second vertical portion 310 extends from angled portion 306 downwardly in approximately the same plane of first vertical portion 302. In some embodiments in which storage system 100 will support extra weight, additional support can be provided by an addition horizontal portion 312 that provides additional strength to beams 106. FIG. 3 shows a solid deck 316, as an alternative to the wire deck 102 of FIG. 1, supported on the top surface of the horizontal portion 302 of beam 106.

Figure 4A:
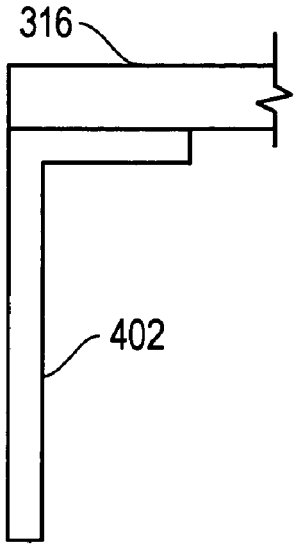
FIG. 4A shows an L-shaped beam that can be used as an alternative to the beam in FIG. 3.
Figure 4B:
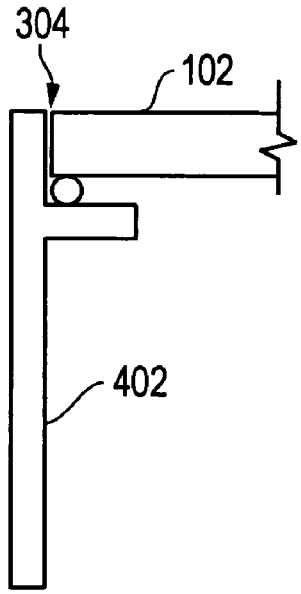
FIG. 4B shows another embodiment of an L-shaped beam that can be used as an alternative to the beam in FIG. 3.
Figure 5A:
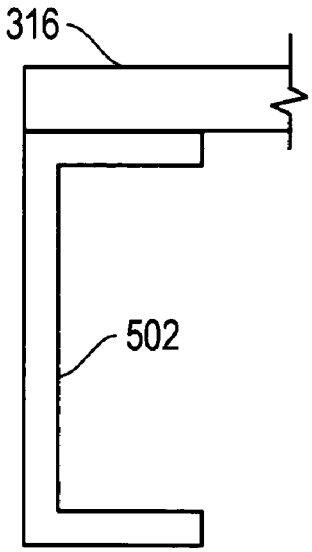
FIG. 5A shows a C-shaped beam that can be used as an alternative to the beam in FIG. 3.
Figure 5B:
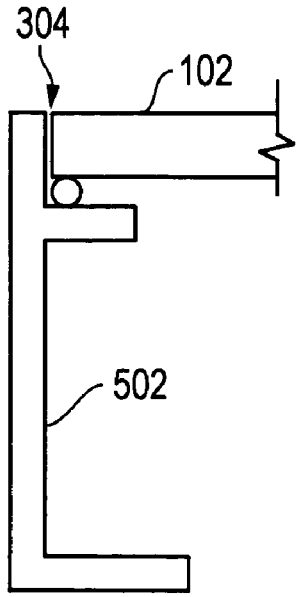
FIG. 5B shows another embodiment of a C-shaped beam that can be used as an alternative to the beam in FIG. 3.

The invention is not limited to the beam configurations shown in FIG. 3. For example, FIGS. 4A and 5A show alternative configurations, an L-shaped beam 402 and a C-shaped beam 502, respectively, both used with a solid deck 316. When such alternative configurations are used, additional brackets (not shown) can optionally be used to fix the position of deck 102. FIGS. 4B and 5B show additional alternative configurations, an L-shaped beam 402 and a C-shaped beam 502, respectively, both used with a wire deck 102.

At each end of each of the four beams 106 are connectors for connecting each beam 106 to a mating connector on the corresponding vertical support 110. A preferred connector does not require an assembler to use a screwdriver or wrench to connect threaded fasteners, thereby facilitating assembly by "do-it-yourself" homeowners. In one embodiment, the connector consists of a post 320 (FIG. 3) and a round flat plate 322 positioned at the end of post 320 and having a diameter larger than that of post 320. The plate is inserted into the large-diameter portion of keyhole 202 (FIG. 2) of vertical corner support 110, and then beam 106 is moved downward until post 320 seats in the narrow end of keyhole slot 202. In a preferred embodiment, a rivet forms post 320 and flat plate 322. Other types of connectors could be used, and the keyhole could be positioned on beams 106, with the rivets on vertical corner connectors 110. In another embodiment, the connectors could be located on the inner surface of the beams so that the vertical supports are located inside the frame. If necessary, deck panels could be notched to accommodate the interior vertical supports.

Figure 6:
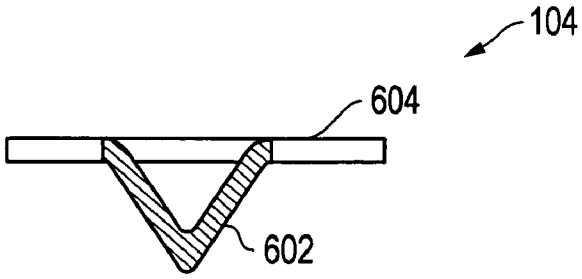
FIG. 6 shows a cross section of a deck rib taken along the lines 6-6 from FIG. 1.

One or more ribs 120 (FIG. 1) typically provide support for deck 102. FIG. 6 shows a cross section, taken as shown by the lines 6-6 of FIG. 1, of a preferred rib 120 for use with a wire deck 102. Rib 120 preferably comprise a V-shaped center portion 602 that provides strength for supporting a load away from the frame 108 and flat end portions 604 that provide additional support for a wire deck 102 near frame 108. The opening of the "V" preferably faces the wire deck 102 to provide more contact area, and the top of the "V" can be flanged to provide a horizontal lip for even more contacting area. The V-shape resists bending along the span between opposing beams 106. Other cross-sectional shapes for the ribs could be used including U-shaped or square. The wires of wire deck 102 typically form a grid pattern, and flat end portions 604 preferably extend away from the frame beyond the end of the first row in the grid, thereby providing broad support for at least the first wire that is away from the frame 108 and that is transverse to the long axis of rib 120. The grid pattern of wire deck 102 can include rectangles (including squares. i.e., rectangles having sides of equal length), diamonds, or other utilitarian or decorative patterns.

Preferably, at least some, and more preferably all, of the wires forming wire deck 102 are bonded to ribs 120, preferably by welding. Bonding the wire deck 102 to the ribs creates a stronger, more rigid deck structure that can support a great deal of weight without sagging. Each of the wires crossing ribs 120 is preferably welded to the rib.

Figure 15A:
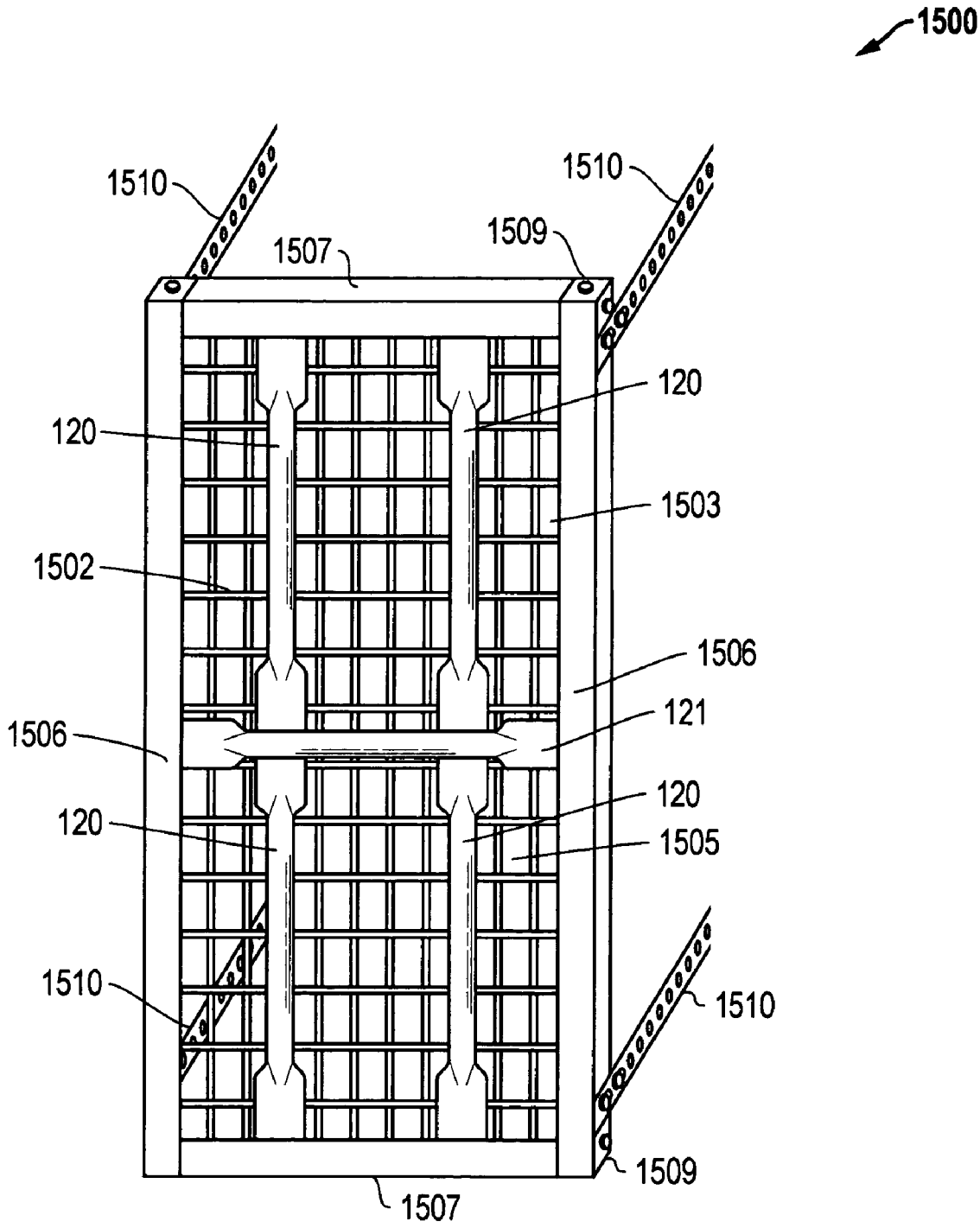
FIG. 15A shows a bottom perspective view of another preferred embodiment of the invention.
Figure 15B:
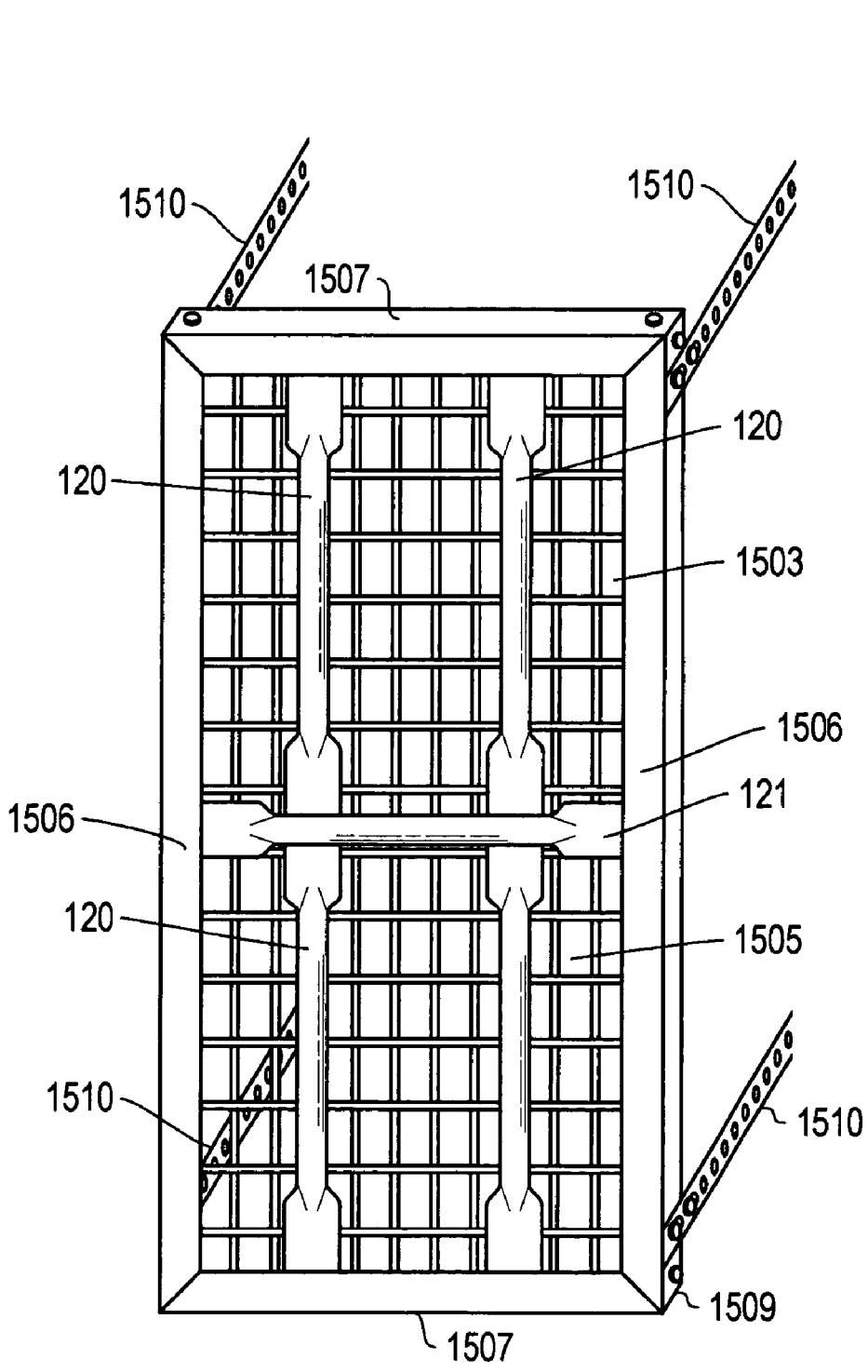
FIG. 15B shows a bottom perspective view of another preferred embodiment of the invention.

In various embodiments, decks 102 are 4 ft×2 ft, 4 ft×4 ft, 6 ft×2 ft, 6 ft×4 ft, 8 ft×2 ft and 8 ft×4 ft, and can made in 3 ft×2 ft or 4 ft×2 ft sections or deck panels, each deck panel including 2 support ribs 120 to which the wires in the deck panel are welded. In some embodiments, decks 102 are 4 ft×3 ft, 6 ft×3 ft and 8 ft×3 ft and are made, for example, in 4 ft×3 ft or 3 ft×2 ft deck panel, with each deck panel having 2 ribs. Referring also to FIGS. 15A and 15B, in one 2 ft by 8 ft embodiment shown in, the deck 102 is preferably composed of two 2 ft by 4 ft welded wire deck panels 1503 and 1505, with two 4 ft support ribs 120 running under each panel. Wires from both panels are welded to the two corresponding support ribs. A 2 ft. cross support 121 runs between the two panels and supports the ends of ribs from each panel. The cross support preferably includes clips (not shown) for attaching the wires from both panels.

Figure 7:
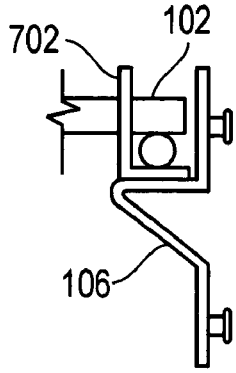
FIG. 7 shows a Z-beam of FIG. 3 with an L-clip for holding a welded wire frame.

Beam 106 can optionally include multiple L-clips 702 as shown in FIG. 7. L-clips 702 are positioned on beams 106 to maintain wire deck 102 in position. L-clips 702 are preferably attached by welding or by threaded fasteners. The vertical portion of L-clips 702 preferably extends vertically to about the same height as the vertical portion 304 of beam 106 to prevent deck 102 from being displaced under load.

In embodiments that support a heavier load, additional support can be provided by center supports 130 (FIG. 1), which can be attached between the ceiling and beams 106. The term "center support" includes any supports positioned between the corner supports 110 and is not limited to supports positioned half way between the corner supports 110. Center supports 130 can preferably be positioned wherever desired along the length of beams 106 to provide additional support where the load is heaviest or to coincide with building structure in the ceiling, such as ceiling joists. In some embodiments, two center supports are used, one attached to the front beam 106 and one attached to the rear beam 106. Additional center supports can be added to accommodate a heavier load. In embodiments that support heavier loads, the beams and vertical supports (including center supports) can be formed from thicker gauge material. For example, vertical supports can be at least 10 gauge and beams can be greater than 14 gauge. As discussed above and shown in FIG. 3, additional weight-bearing support for the beams can also be provided by an addition horizontal portion 312 that provides additional strength to beams 106.

Figure 8:
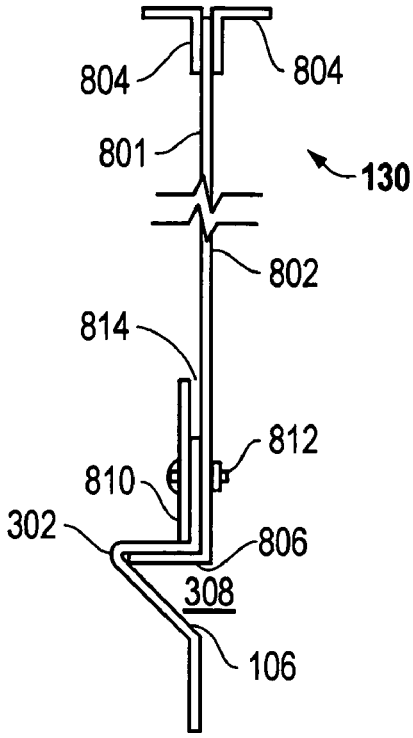
FIG. 8 shows a connection between a center support and a Z-beam of FIG. 3.

FIG. 8 shows that a typical center support 130 includes a top vertical portion 801 to which are attached one or two L-shaped brackets 804 for attaching to a ceiling joist or other structural component (not shown). Center support 130 also includes a bottom portion 802 attached to upper portion 801 using threaded fasteners or other means such as interlocking slots. Bottom portion 802 includes a bent portion 806 that fits into the indention 308 in beam 106 to provide support to beam 106. Bent portion 806 preferably extends into indentation 308 until it touches or almost touches angled portion 306 of beam 106. A bolt 812 clamps vertical portion 304 of beam 106 between a square plate 810 and bottom portion 802 of center support 130 to secure center support 130 to beam 106. A spacer 814 fills the gap between portion 802 and plate 810 near the bolt location. An L-clip 702 (FIG. 7) is preferably positioned below bolt 812, and the bolt or an its associated hardware, such as a lock-washer, extends deck over a wire from wire deck 102 to trap the wire between the L-clip and the bolt or its hardware, thereby prevented wire deck 102 from coming off of its support structure without removal of the bolt.

Because the attachment of center support 130 to beam 106 does not require a hole in beam 106 at the point of attachment, center support 130 can be attached anywhere along the length of beam 106, and the position is not limited by the location of holes in beam 106. The position at which center support 130 is attached can be varied by the end user depending on the load distribution and on the position of ceiling structural members, such as ceiling joists. The center support is preferably positionable at any point along a continuous portion of the beams 106, meaning that the position along the beam is not limited by the location of holes in the beam, although there may still be specific points along the length of beam 106 at which the center support cannot be positioned because of interfering structural features. Also, because no holes are necessary in beam 106, the beam is stronger and can support additional weight without requiring a larger, heavier beam.

Thus, the present invention provides great flexibility. For example, in some embodiments, if heavier items are loaded toward one end of deck 102, additional center support brackets 130 can be used to provide additional support. In some embodiments, additional deck ribs 120 can also be added in that area to shore up the deck. Thus, the present invention provides great flexibility. For example, in some embodiments, if heavier items are loaded toward one end of deck 102, additional center support brackets 130 can be used to provide additional support. In some embodiments, additional deck ribs 120 can also be added in that area to shore up the deck. In other embodiments, one or more center supports can be used to replace some or all of the fixed vertical supports discussed above. Skilled persons will recognize that in these embodiments the center supports can be mounted at the corners of the deck or at other positions as long as the deck is adequately supported.

The upper end of corner supports 112 (FIG. 1) are preferably attached to L-shaped ceiling brackets 140, which are attached to a building structure, such as ceiling joists, trusses, or beams, preferably wooden beams or metal joists. Brackets 140 are typically bolted onto the upper vertical corner support 112, and the other arm of the L-shaped bracket 140 is then attached using screws or other fastening devices to a building structural component. Slots in the bracket 140 provide some adjustment for aligning the brackets with building structural components. Bracket 140 can be attached to either face of support 112, so that bracket 140 can be oriented parallel to the building structural component to facilitate attachment. Ceiling brackets 140 can be of any desired length, for example the brackets can be long enough to span and be mounted to several ceiling joists.

Figure 9:
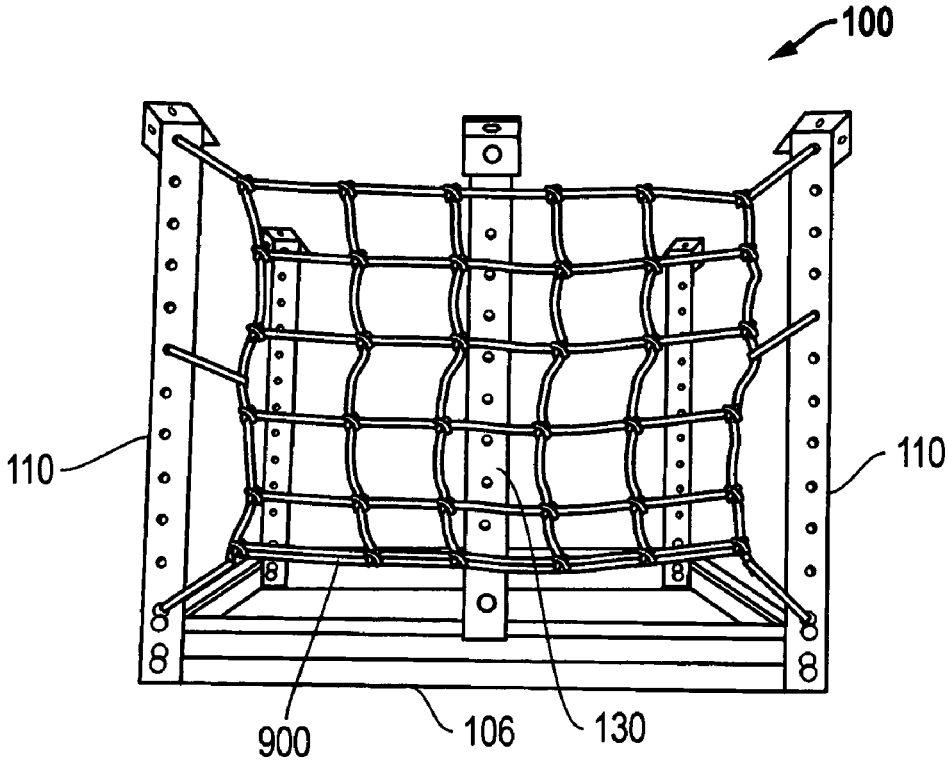
FIG. 9 shows a storage system having a net for holding the items stored.
Figure 10:
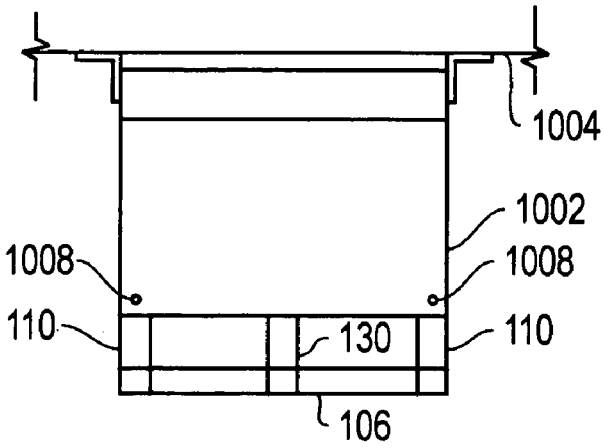
FIG. 10 shows a storage system having a retractable shade for hiding the contents of the storage system.

FIG. 9 shows that holes or brackets in the corner brackets 110 can be used to support a net 900 or other structure that keeps items on deck 102 from falling off. FIG. 10 shows that a shade 1002 can be mounted on a ceiling 1004 or on brackets 110 of storage system 100. FIG. 9 shows the shade about three-quarters of the way down. Multiple shades 1002 can be pulled down to hide the contents of storage system 100. Each shade 1002 includes a magnetic strip 1008 to hold the bottom of the shade in place against beam 106. Mechanical clips or hooks could also be used to keep the drawn shade in place.

Storage system can be made in various sizes, and the number of center supports 130 and deck support ribs 120 can be varied with the overall size of the unit and the weight to be carried. Because deck 102 preferably does not extend past frame 108, multiple storage units 100 can be positioned next to each other, with the frames juxtaposed. The L-shaped vertical corner supports facilitate bolting units together on any side. Combining units increases the overall storage area by allowing an end user to create a loft composed of several systems.

many case, the inventive system is so strong that the maximum load of an installed system is limited not by the strength of the system itself, but by the load bearing capacity of the building structural components to which the system is attached. For example, one embodiment of a four foot by eight foot system that uses 8 deck rib supports and four center beam supports, two along the front beam and two along the rear beam, can support 1000 pounds or more, although a lighter load is recommended if the structure is suspended from ceiling joists of a residential garage. Some smaller embodiments, such as those having a maximum dimension of four feet or less, may not include center supports. Embodiments that are six feet typically use two center supports. Whether or not center supports are used in any embodiment will depend on the load to be carried.

Table 1 below is a table that describes various embodiments.

TABLE 1

| Size (Feet) | Approx Weight (Pounds) | Sliding Center Supports (Quantity) | No. of Wire Deck Panels (Size in feet) | Rib Deck Supports (Quantity) | Maximum Load Capacity Residential (Structural) (Pounds) |
|---|---|---|---|---|---|
| 4 × 2 | 35 | 0 | 1 (4 × 2) | 2 | 400 (600) |
| 4 × 3 | 45 | 0 | 1 (4 × 3) | 2 | 400 (600) |
| 4 × 4 | 50 | 0 | 2 (4 × 2) | 4 | 500 (700) |
| 6 × 2 | 60 | 2 | 2 (3 × 2) | 4 + 1 center rib | 600 (1000) |
| 6 × 3 | 65 | 2 | 3 (3 × 2) | 6 | 600 (1000) |
| 6 × 4 | 75 | 2 | 3 (4 × 2) | 6 | 600 (1000) |
| 8 × 2 | 80 | 2 | 2 (4 × 2) | 4 + 1 center rib | 600 (1000) |
| 8 × 3 | 85 | 2 | 4 (3 × 2) | 8 | 600 (1000) |
| 8 × 4 | 90 | 2 | 4 (4 × 2) | 8 | 600 (1000) |

Figure 11:
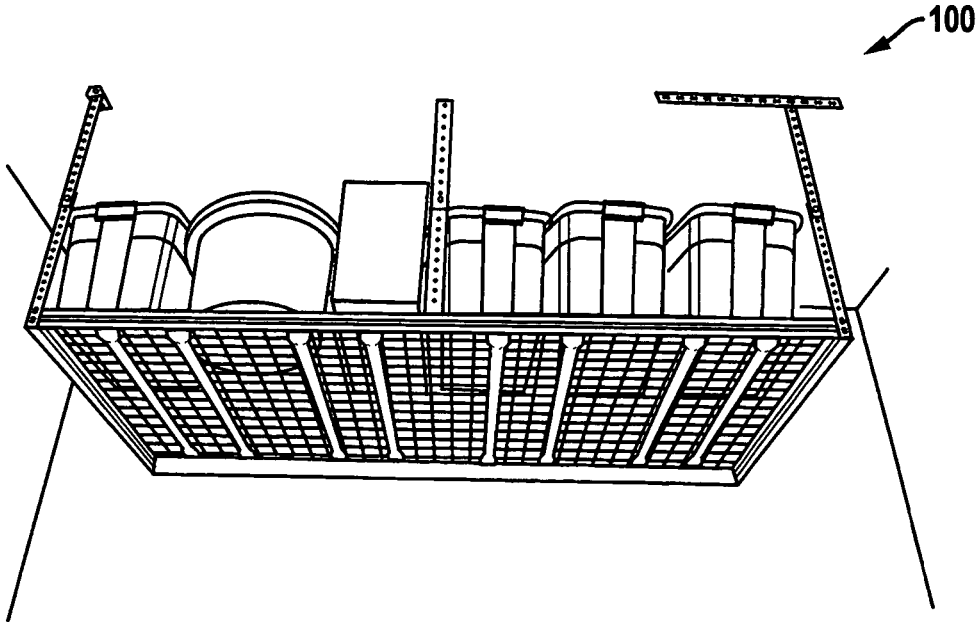
FIG. 11 shows a storage system storing items.
Figure 12:
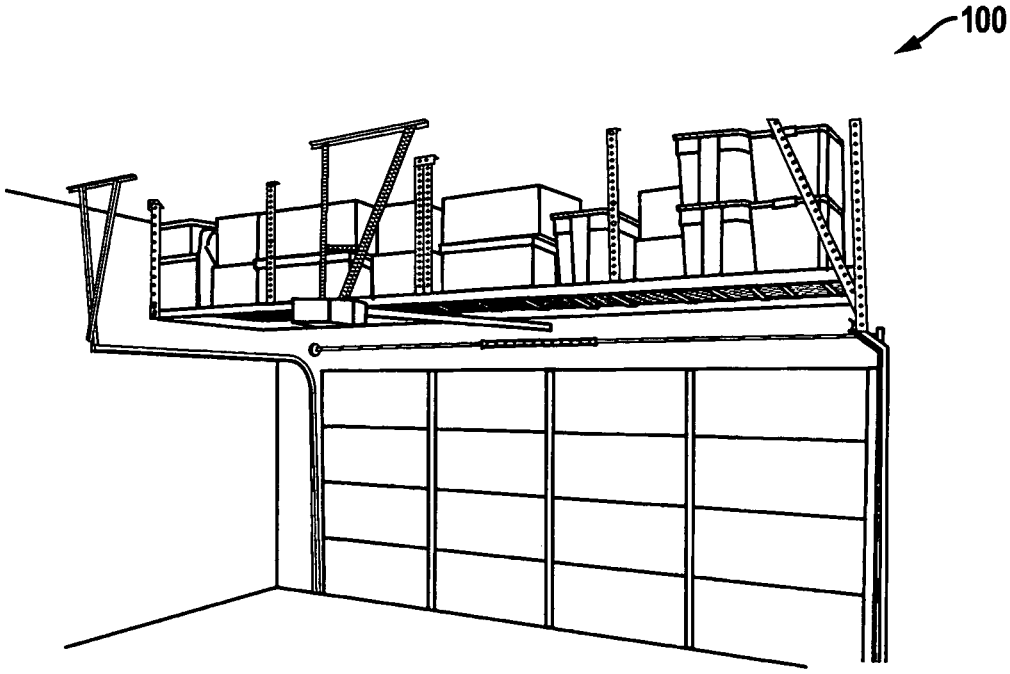
FIG. 12 shows a storage system mounted above the rails of a garage door.

FIG. 11 shows a typical storage system 100 with items stored thereon. Some embodiments of the storage system, such as that shown in FIG. 12, are suitable for mounting above the rails of a sliding overhead garage door, thereby making additional storage space available. While suitable for use in a residential garage, the invention is not limited to such use, and can be used wherever overhead storage is desired.

Figure 13:
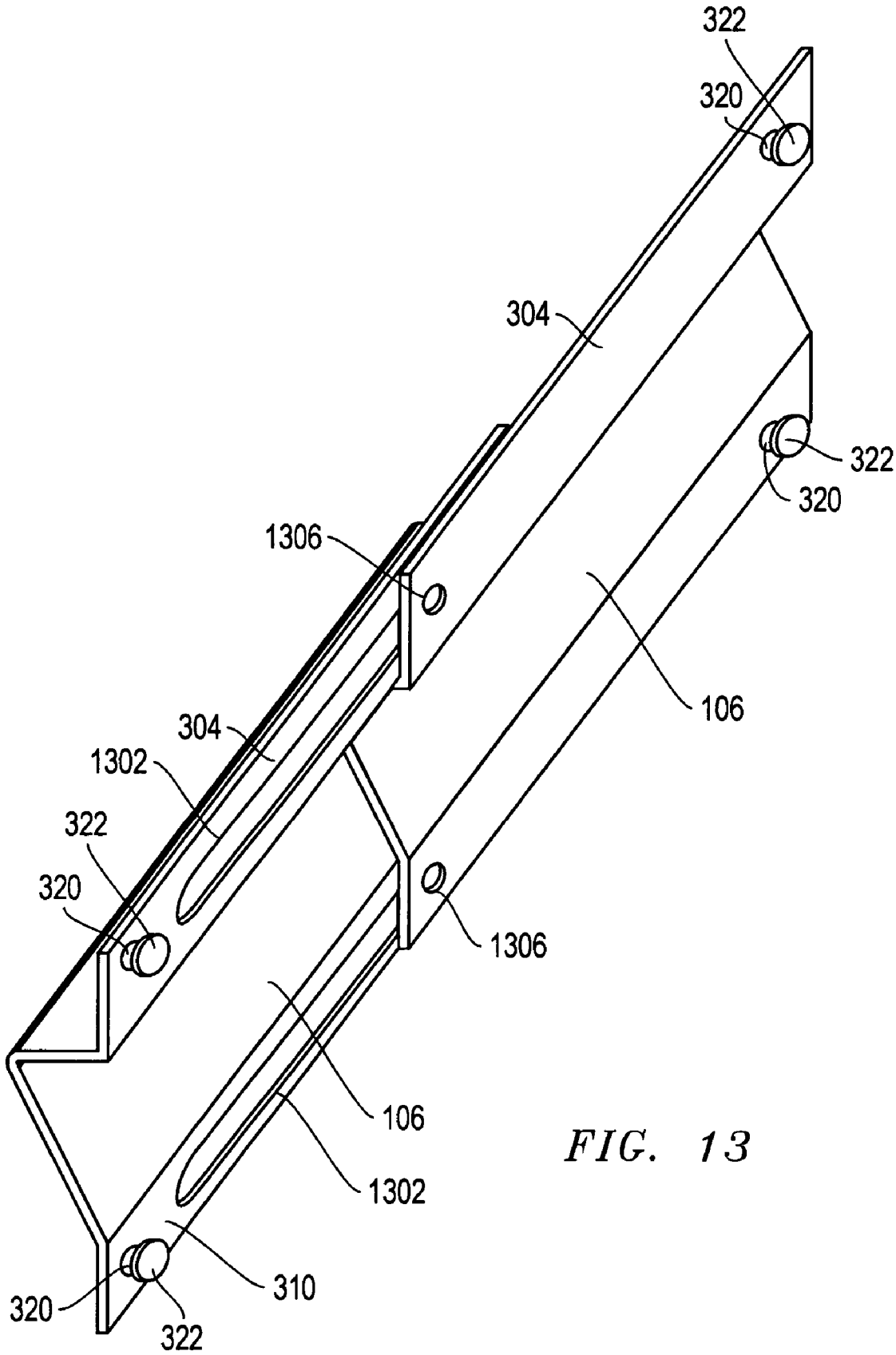
FIG. 13 shows an expandable beam used to make a storage system having at least one adjustable dimension.
Figure 14:
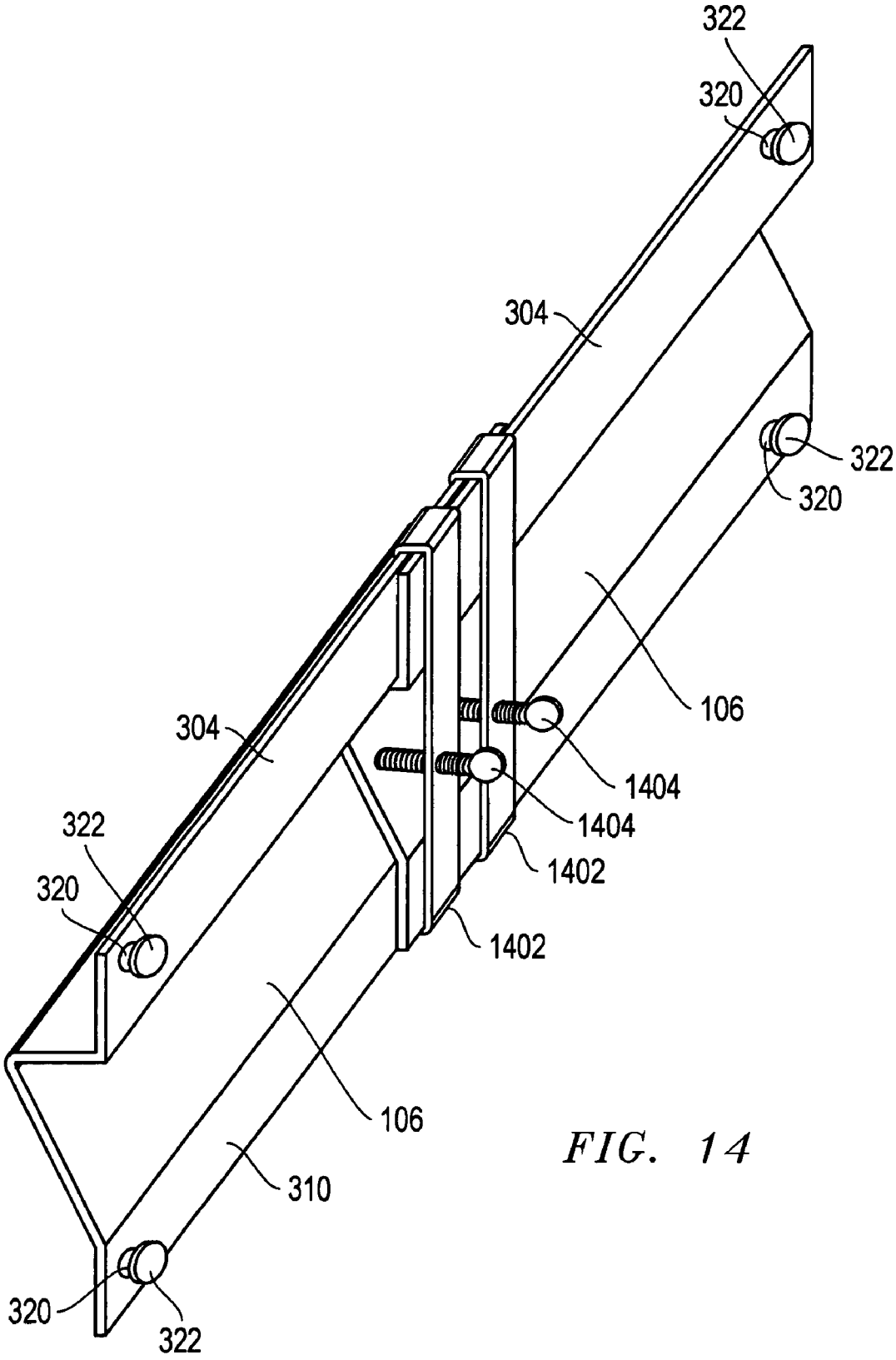
FIG. 14 shows an alternative expandable beam used to make a storage system having at least one adjustable dimension.

FIG. 13 shows an alternative embodiment in which beams 106 can be configured in two parts that slide into one another, to make a system having an adjustable length and/or width. One beam 106 includes two slots 1302, one in the top portion 304 and one in the lower portion 310. The other beam includes near its end holes 1306 for a connector that can be secured with nuts or a threaded backing plate to keep the beam sections together. Suitable connectors can include, for example, bolts passing through both beams, permanent rivets at predetermined locations or slidable rivets on the first beam. Clamps such as those shown in FIG. 14 below can also be used to hold the beams together. FIG. 14 shows an alternative embodiment in which beams 106 can be configured in two parts that slide into one another, to make a system having an adjustable length and/or width. Two clamps 1402 including bolts 1404 hold the two beams 106 together. In some embodiments, each clamp 1402 will include 2 bolts, one positioned near the top and one near the bottom of each clamp, to press against vertical surfaces 304 and 310, respectively.

Embodiments of the invention that use a Z-beam frame and a wire deck welded to support ribs provide a very stable, sturdy structure that is relatively light weight, so that more of the load bearing capacity of the building structural component is available for useful load. The adjustable center supports used in some embodiments spread the load on the building component, thereby increasing the maximum capacity. In FIG. 15A shows another preferred embodiment of the present invention. In FIG. 15, suspended storage structure 1500 includes a rectangular shelf or deck 1502 formed by positioning two substantially square deck panels 1503 and 1505 side by side. The deck panels can be, for example, a welded wire mesh, as shown, or a solid sheet, such as plywood, metal, or plastic. Deck 1502 is supported by transverse beams 1507 and longitudinal beams 1506 that form a rectangular frame 1508. Transverse beams 1507 do not extend lengthways past the lateral edges of deck 1502. Longitudinal beams 1506 extend to the outside edges of transverse beams so that transverse beams 1507 are butted up against the interior surface of longitudinal beams 1506. The corresponding lateral ends of transverse beams 1507 and longitudinal beams 1506 can be attached, for example, by an L-shaped bracket 1509 welded or otherwise attached to the outside corner formed by the two beams. Transverse beams 1507 are suspended from vertical supports 1510. One or more ribs 120 provide support for each deck panel. Cross support 121 runs between the two panels and supports the ends of ribs from each panel.

The vertical supports shown in FIG. 15A comprise supports mounted near each corner of deck 1502. The vertical supports do not have to be mounted directly at the corners of the frame. Instead, the mounting position can be varied to allow, for example, the location of the vertical supports to match the location of ceiling joists, or to allow for a larger opening between supports so that larger objects can be stored on the shelf. In some embodiments, vertical supports can be flat bar steel (or other appropriate material) rather than the L-shaped steel supports discussed above in order to reduce manufacturing costs.

FIG. 15B shows another preferred embodiment of the present invention. In FIG. 15B, deck panels 1503 and 1505 are positioned side by side and supported by longitudinal beams 1506 supporting both deck panels 1503 and by transverse beams 1507 each supporting only one panel. Longitudinal beams 1506 are suspended from vertical supports 1510. The vertical supports shown in FIG. 15B comprise supports mounted near each end of longitudinal beams 1506.

All configurations and dimensions described above are by way of example only, and the invention is not limited to any specific dimension or configuration of the novel aspects. Skilled persons will recognize that many brackets can be used on the ends of beams and support structures to facilitate connection, so when applicant states that one part is connected to another part, it is understood that the connection does not need to be immediate and such connection does not exclude the use of intermediary brackets.

Figure 16:
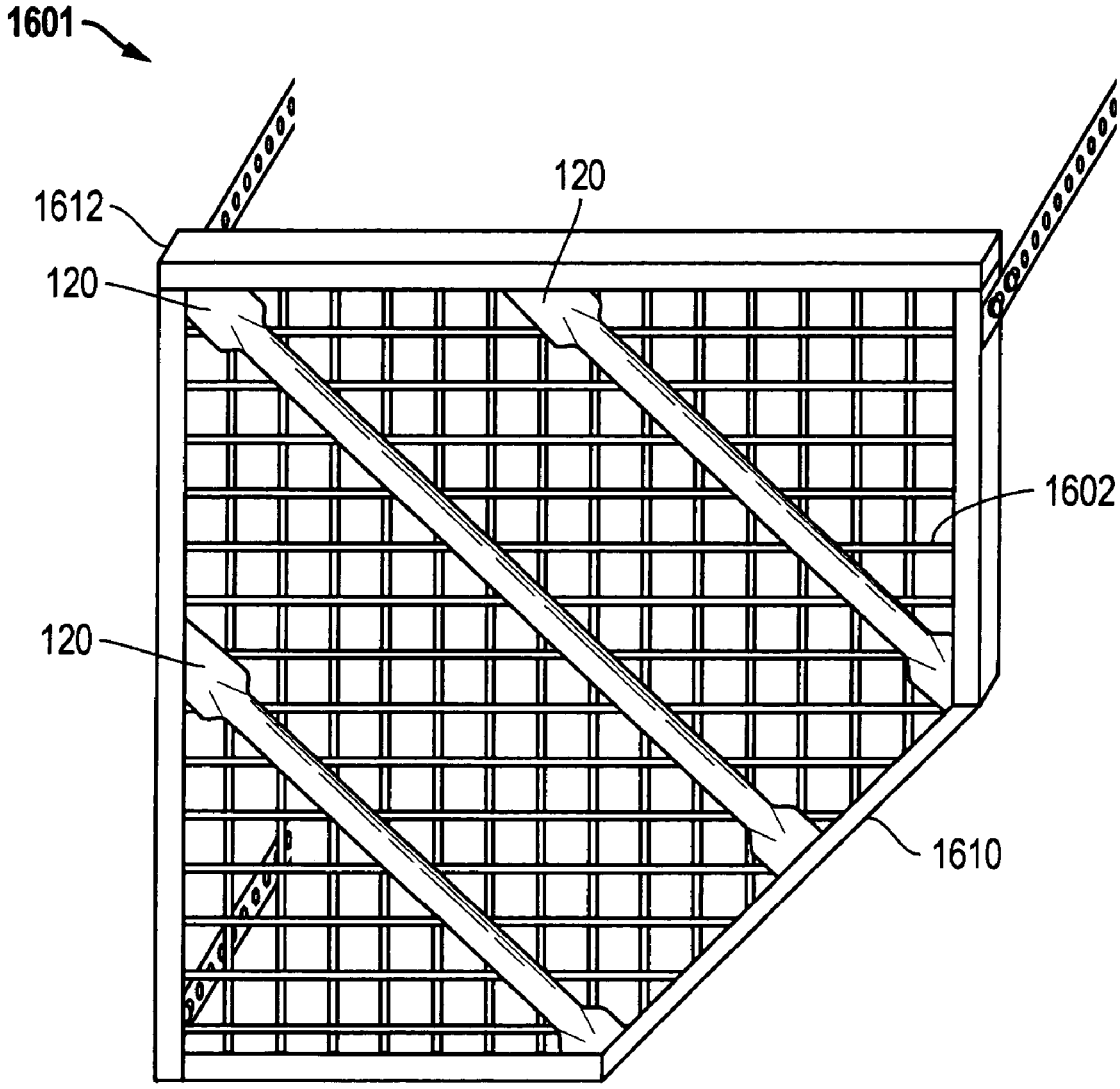
FIG. 16 shows another preferred embodiment of the present invention where the storage system is generally triangular in shape.

While rectangular and square decks have been described, the invention is not limited to any particular shape of deck. As shown in FIG. 16, the invention could be used for a triangular storage system for mounting in a corner, the system including three beams instead of four, and the internal angles of some of the support brackets being less than ninety degrees. FIG. 16 shows a triangular storage system 1601 using three parallel support ribs 120 oriented perpendicular to the front edge of the triangular deck frame 1602. For applications where less support is needed, only one support rib can be used, preferably oriented perpendicular to the front edge 1610 of the triangular deck frame 1602 and running from the back corner 1612 to the front edge 1610.

As used herein, the term "L-shaped" does not exclude a shape in which the two sides of the "L" have equal length or a shape in which the angle of intersection between the arms varies from ninety degrees. Also, as used herein, the term "rectangle" includes a square. Further, as used herein the term "deck" can refer to a deck formed as one unit or formed from multiple smaller deck panels.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. A storage system for suspending from an overhead structure, comprising:

a deck for storing items;

at least two beams supporting the deck, each of the at least two beams including a horizontal portion, a vertical lip extending above the horizontal portion, and an angled portion extending below the horizontal portion beginning on the opposite side from the vertical portion and extending at an angle downward and toward the plane of the vertical lip so that an indentation is formed below the horizontal portion;

four vertical supports for supporting the at least two beams;

at least one center support further supporting at least one of the beams, the center support being positionable independently of any other vertical support at any point along a continuous portion of the supported beam, the position along the beam not being limited by the location of particular features along the beam length, thereby providing additional support to the beam and the deck at a position determinable by the user;

the at least one center support including an upper portion for attaching to a ceiling and a lower horizontal portion for attaching to at least one of the beams; and at least one beam including a horizontal portion providing a flat area for supporting the deck, said horizontal portion supported by contact between the horizontal portion of the at least one center support and the horizontal portion of the beam.

2. The storage system of claim 1 in which the at least one center support includes a vertical portion and a horizontal portion, the horizontal portion of the center support positioned in the indention of the beam so that the horizontal portion of the center support is hooked under the horizontal portion of the beam to support the beam, and in which the. vertical lip of the beam is clamped between the vertical portion of the center support and a clamping member positioned on the opposite side of the vertical lip from the vertical portion of the center support, to sandwich the vertical lip.

3. The storage system of claim 2 in which the clamping member includes a plate.

4. The storage system of claim 2 in which the deck comprises a wire deck and in which a clamping hardware maintains the vertical lip tightly sandwiched between the vertical portion of the center support and the clamping member and in which the clamping hardware traps the wire deck between an L-shaped bracket mounted on the beam the clamping hardware.

5. A storage system for suspending from an overhead structure, comprising:

a deck for storing items;

at least two beams supporting the deck, at least one of the beams including a first vertical above the portion extending above a horizontal portion, an angled portion extending below the horizontal portion beginning on the opposite side from the vertical portion and extending at an angle downward and toward the plane of the first vertical portion and a second vertical portion extending downward from the angled portion;

four vertical supports for supporting the at least two beams;

at least one center support, the center support being positionable at any point along a continuous portion of at least one of the beams, the position along the beam not being limited by the location of particular features along the beam length, thereby providing additional support to the beam and the deck at a position determinable by the user.

6. The storage system of claim 5 in which the at least one beam further comprises a second horizontal portion extending from the bottom of the second vertical portion.

7. A storage system for suspending from an overhead structure, comprising:

a deck for storing items;

at least two beams supporting the deck, each of the at least two beams including a horizontal portion, a vertical lip extending above the horizontal portion, and an angled portion extending below the horizontal portion beginning on the opposite side from the vertical portion and extending at an angle downward and toward the plane of the vertical lip so that an indentation is formed below the horizontal portion;

at least four vertical supports for supporting the at least two beams;

at least one vertical support being positionable independently of the other vertical supports at any point along a continuous portion of at least one of the beams, the position along the beam not being limited by the location of particular features along the beam length, thereby providing support to the beam and the deck at a position determinable by the user, and the at least one independently positionable vertical support including an upper portion for attaching to a ceiling and a lower horizontal portion for attaching to at least one of the beams; and the horizontal portion of at least one of said beams providing a flat area for supporting the deck, said horizontal portion supported by contact between the horizontal portion of the at least one independently positionable vertical support and the horizontal portion of the beam.

8. The storage system of 7 in which the at least one independently positionable vertical support includes a vertical portion and a horizontal portion, the horizontal portion of the independently positionable vertical support positioned in the indention of the beam so that the horizontal portion of the independently positionable vertical support is hooked under the horizontal portion of the beam to support the beam, and in which the vertical lip of the beam is clamped between the vertical portion of the independently positionable vertical support and a clamping member positioned on the opposite side of the vertical lip from the vertical portion of the independently positionable vertical support, to sandwich the vertical lip.

9. A storage system for suspending from an overhead structure, comprising:

a deck for storing items;

at least two beams supporting the deck, at least one beam including a first vertical portion extending above the horizontal portion, an angled portion extending below the horizontal portion beginning on the opposite side from the vertical portion and extending at an angle downward and toward the plane of the first vertical portion, and a second vertical portion extending downward from the angled portion;

at least four vertical supports for supporting the at least two beams;

at least one vertical support being positionable independently of the other vertical supports at any point along a continuous portion of at least one of the beams, the position along the beam not being limited by the location of particular features along the beam length, thereby providing support to the beam and the deck at a position determinable by the user.

10. The storage system of claim 5 in which the deck comprises a welded wire deck.

11. The storage system of claim 10 further comprising at least one support rib extending from one beam toward an opposing beam, the rib being bonded to the welded wire deck and having a center V-shaped portion and flat end portions.

12. The storage system of claim 5 in which:

at least one center support includes a upper portion for attaching to a ceiling and a lower horizontal portion for attaching to at least one of the beams; and at least one beam includes a horizontal portion providing a flat area for supporting the deck so that the horizontal portion of said beam can be supported by contact with the horizontal portion of the at least one center support.

13. The storage system of claim 5 in which the at least two beams supporting the deck comprise four beams forming a rectangle with four corners.

14. The storage system of claim 13 in which:

the four vertical supports comprise supports with an L-shaped cross-section; and the four beams and the four vertical supports comprise mating connectors for connecting each corner with a corresponding vertical support.

15. The storage system of claim 14 in which the four beams and the four vertical supports include mating connectors for connecting each corner with a corresponding vertical support without the use of fasteners requiring threading by an assembler.

16. The storage system of claim 5 in which the one or more beams have an adjustable length, thereby accommodating a storage structure of varying sizes.

17. The storage system of claim 5 in which the four vertical supports and the at least one center support each comprise an upper member and a lower member which are adjustably coupled together so that the length of the vertical and center supports can be manually adjusted to vary the distance between the deck and the overhead structure.

18. The overhead storage system of claim 1 in which the deck comprises a welded wire deck.

19. The overhead storage system of claim 18 further comprising at least one support rib extending from one beam toward an opposing beam, the rib being bonded to the welded wire deck and having a center V-shaped portion and flat end portions.

20. The overhead storage system of claim 1 in which the frame is formed by four beams arranged to form a rectangle, said beams being coupled together at the corners of the rectangle by L-shaped corner brackets.

21. The storage system of claim 1 in which at least one beam supporting the deck further comprises a second horizontal portion extending from the bottom of the second vertical portion.

* * * * *